US011042120B2

(12) United States Patent
Charbon et al.

(10) Patent No.: US 11,042,120 B2
(45) Date of Patent: Jun. 22, 2021

(54) TIMEPIECE COMPONENT CONTAINING A HIGH-ENTROPY ALLOY

(71) Applicant: Nivarox-FAR S.A., Le Locle (CH)

(72) Inventors: Christian Charbon, Chezard-St-Martin (CH); Guido Plankert, Boppelsen (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 16/775,657

(22) Filed: Jan. 29, 2020

(65) Prior Publication Data

US 2020/0241475 A1 Jul. 30, 2020

Related U.S. Application Data

(63) Continuation of application No. 16/331,038, filed as application No. PCT/EP2017/069219 on Jul. 28, 2017.

(30) Foreign Application Priority Data

Sep. 30, 2016 (EP) ..... 16191867

(51) Int. Cl.

| | |
|---|---|
| ***G04B 1/14*** | (2006.01) |
| ***C22C 38/52*** | (2006.01) |
| ***C22C 38/30*** | (2006.01) |
| ***C22C 38/38*** | (2006.01) |
| ***G04B 37/22*** | (2006.01) |
| ***G04B 29/02*** | (2006.01) |
| ***C22C 27/06*** | (2006.01) |

(Continued)

(52) U.S. Cl.

CPC ..... *G04B 1/145* (2013.01); *C22C 27/06* (2013.01); *C22C 38/30* (2013.01); *C22C 38/38* (2013.01); *C22C 38/52* (2013.01); *G04B 5/16* (2013.01); *G04B 13/026* (2013.01); *G04B 29/027* (2013.01); *G04B 37/22* (2013.01)

(58) Field of Classification Search

CPC ..... C22C 27/06; C22C 38/30; C22C 38/38; C22C 38/52; G04B 13/026; G04B 1/145; G04B 29/027; G04B 37/22; G04B 5/16

See application file for complete search history.

(56) References Cited

U.S. PATENT DOCUMENTS

| | | | |
|---|---|---|---|
| 3,928,085 | A | 12/1975 | Yamamura et al. |
| 2007/0133355 | A1 | 6/2007 | Hara et al. |
| 2017/0167003 | A1 | 6/2017 | Baker et al. |

FOREIGN PATENT DOCUMENTS

| | | | |
|---|---|---|---|
| CH | 299223 | A | 5/1954 |
| GB | 647783 | A | 12/1950 |
| WO | WO 2005/045532 | A2 | 5/2005 |

OTHER PUBLICATIONS

Effects of Al addition on structural evolution and tensile properties of the FeCoNiCrMn high-entropy alloy system J.Y. He, W.H. Liu (Year: 2014) (Year: 2014).*

(Continued)

*Primary Examiner* — Jenny R Wu

(74) *Attorney, Agent, or Firm* — Oblon, McClelland, Maier & Neustadt, L.L.P.

(57) ABSTRACT

The invention concerns a timepiece component containing a high-entropy alloy, the high-entropy alloy containing between 4 and 13 main alloying elements forming a single solid solution, the high-entropy alloy having a concentration of each main alloying element comprised between 1 and 55 at. %.

3 Claims, 1 Drawing Sheet

(51) Int. Cl.
*G04B 5/16* (2006.01)
*G04B 13/02* (2006.01)

(56) References Cited

OTHER PUBLICATIONS

A novel, single phase, non-equiatomic FeMnNiCoCr high-entropy alloy with exceptional phase stability and tensile ductility M.J. Yao, K.G. Pradeep,.C.C. Tasan and D. Raabe (Year: 2014) (Year: 2014).*
Khaled M. Youssef A Novel Low-Density, High-Hardness, High-entropy Alloy with Close-packed Single-phase Nanocrystalline Structures Material Research Letters 2014 (Year: 2014) (Year: 2014).*
Zhiming Li Metastable high-entropy dual-phase alloys overcome the strength-ductility trade-off Jun. 2016 vol. 534 Nature 227-230 (Year: 2016) (Year: 2016).*
Nano-twin mediated plasticity in carbon-containing FeNiCoCrMn high entropy alloys Wu (Year: 2015).*
Design of a twinning-induced plasticity high entropy alloy Deng (Year: 2015).*
International Search Report dated Sep. 28, 2017 in PCT/EP2017/069219 filed Jul. 28, 2017.
O. N. Senkov, et al. "Microstructure and room temperature properties of a high-entropy TaNbHfZrTi alloy," Journal of Alloys and Compounds, vol. 509, 2011, pp. 6043-6048.
Chung-Chin Tung, et al. "On the elemental effect of AlCoCrCuFeNi high-entropy alloy system," Materials Letters, vol. 61, 2007, pp. 1-5.
Khaled M. Youssef, et al. "A novel low-density, high-hardness, high-entropy allow with close-packed single-phase nanocrystalline structures," Materials Research Letters, 2014, 7 pages.
Zhiming Li, et al. "Metastable high-entropy dual-phase alloys overcome the strength-ductility trade-off," Nature, vol. 534, Jun. 9, 2016, 8 pages.
Notice of the Reason for Refusal dated Sep. 15, 2020 in Japanese Patent Application No. 2019-513437 (with English translation), 6 pages.

* cited by examiner

TIMEPIECE COMPONENT CONTAINING A HIGH-ENTROPY ALLOY

CROSS REFERENCE TO RELATED APPLICATIONS

The present application is a continuation of U.S. Ser. No. 16/331,038, filed Mar. 6, 2019, pending, which is a 371 of PCT application no. PCT/EP2017/069219, filed Jul. 28, 2017, no inactive, and claims priority to European application EP16191867.7, filed Sep. 30, 2016.

FIELD OF THE INVENTION

The present invention concerns a timepiece component containing a high-entropy alloy, and a method for fabricating such a timepiece component. The invention also concerns the use of a high-entropy alloy for fabricating a timepiece component.

PRIOR ART

Timepiece components, and especially mainsprings, are subjected to high stresses, particularly during fabrication processes, but also during use.

They must, in particular, offer high mechanical strength and high ductility. However, at present, timepiece components rarely simultaneously offer these antagonistic features.

SUMMARY OF THE INVENTION

It is an object of the invention to overcome the drawbacks of the state of the art by proposing a timepiece component offering higher mechanical strength and higher ductility.

To achieve this, there is proposed, according to a first aspect of the invention, a timepiece component containing a high-entropy alloy, the high-entropy alloy containing between 4 and 13 main alloying elements forming a single solid solution, the high-entropy alloy having a concentration of each main alloying element comprised between 1 and 55 at. %. Indeed, such a component has higher mechanical strength and higher ductility than those of the prior art.

Advantageously, the concentration of each main alloying element is comprised between 10 and 55 at. %.

According to different preferred embodiments:

- the high-entropy alloy may satisfy the following formula: $Fe_aMn_bCo_cCr_d$ where a, b, c et d are comprised between 1 and 55 at. %;
- the high-entropy alloy may have the following formula: $Fe_{50}Mn_{30}Co_{10}Cr_{10}$;
- the high-entropy alloy may satisfy the following formula: $Fe_{80-x}Mn_xCo_{10}Cr_{10}$, where x is comprised between 25 and 79 at. %, and preferably x is comprised between 25 and 45 at. %;
- the high-entropy alloy may satisfy the following formula: $Fe_aMn_bNi_eCo_cCr_d$ where a, b, c, d and e are comprised between 1 and 55 at. %;
- the high-entropy alloy may satisfy the following formula: $Fe_{20}Mn_{20}Ni_{20}Co_{20}Cr_{20}$;
- the high-entropy alloy may satisfy the following formula: $Fe_{40}Mn_{27}Ni_{26}Co_5Cr_2$;
- the high-entropy alloy may satisfy the following formula: $Ta_aNb_bHf_cZr_dCr_e$ where a, b, c, d and e are comprised between 1 and 55 at. %;
- the high-entropy alloy may, in particular, satisfy the following formula: $Ta_{20}Nb_{20}Hf_{20}Zr_{20}Ti_{20}$;

- the high-entropy alloy may satisfy the following formula: $Al_aLi_bMg_cSc_dTi_e$ where a, b, c, d and e are comprised between 1 and 55 at. %;
- the high-entropy alloy may, in particular, satisfy the following formula: $Al_{20}Li_{20}Mg_{10}Sc_{20}Ti_{30}$;
- the high-entropy alloy may satisfy the following formula: $Al_aCo_bCr_cCu_dFe_eNi_f$ where a, b, c, d, e and f are comprised between 1 and 55 at. %.
- the high-entropy alloy may satisfy the following formula: $Cr_{18.2}Fe_{18.2}Co_{18.2}Ni_{18.2}Cu_{18.2}Al_{9.0}$.

Advantageously, the high-entropy alloy may contain one or more interstitial elements from among the following: C, N, B. These interstitial elements further increase the mechanical strength of the alloy.

Advantageously, the high-entropy alloy may contain one or more structural hardening elements from among the following: Ti, Al, Be, Nb, preferably in a mass concentration comprised between 0.1 and 3%.

According to different embodiments, the timepiece component may be one of the following: a spring, a mainspring, a jumper spring, an impulse pin, a roller, pallets, a staff, a pallet lever, a pallet fork, a wheel, an escape wheel, an arbor, a pinion, an oscillating weight, a winding stem, a crown, a watch case, a bracelet link, a watch bezel, a bracelet clasp.

A second aspect of the invention also concerns the use of a high-entropy alloy for fabricating a timepiece component, the high-entropy alloy containing between 4 and 13 main alloying elements forming a single solid solution, the alloy having a concentration of each main alloying element comprised between 1 and 55 at. %.

BRIEF DESCRIPTION OF THE DRAWINGS

Other features and advantages of the present invention will appear more clearly in the following detailed description of preferred embodiments, given by way of non-liming examples with reference to the appended Figures, in which.

DETAILED DESCRIPTION

Figure 1:
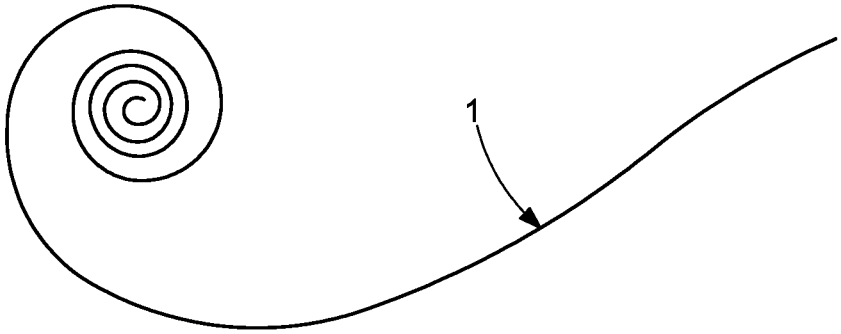
FIG. 1 schematically represents a mainspring according to one embodiment of the invention.

FIG. 1 schematically represents a mainspring 1 according to one embodiment of the invention. This mainspring 1 is made of a high-entropy alloy.

In such a high-entropy alloy, the entropy of mixing is high and makes the single phase more thermodynamically stable than the mixing of several phases.

The mainspring is preferably made from the high-entropy alloy described in the publication 'Metastable high-entropy dual-phase alloys overcome the strength-ductility trade-off', Zhiming Li et al, Nature 534, 227-230 (9 Jun. 2016). This high-entropy alloy has the following formula: $Fe_{80-x}Mn_xCo_{10}Cr_{10}$. x is preferably comprised between 25 and 79 at. %.

More precisely, according to a first embodiment, the mainspring may be made from a $Fe_{35}Mn_{45}Co_{10}Cr_{10}$ alloy. The mainspring produced in this manner has the advantage of combining high tensile strength and high ductility.

According to a second embodiment, the mainspring may be made from a $Fe_{40}Mn_{40}Co_{10}Cr_{10}$.alloy. The spring produced in this manner has the advantage of high tensile strength and high ductility. It also operates according to a TWIP (twinning induced plasticity) mechanism.

According to a third embodiment, the mainspring may be made from a $Fe_{45}Mn_{35}Co_{10}Cr_{10}$ alloy. The mainspring produced in this manner has the advantage of having even higher tensile strength and higher ductility. It also operates according to a TRIP (transformation induced plasticity) mechanism.

According to a fourth embodiment, the mainspring can be made from a $Fe_{50}Mn_{30}Co_{10}Cr_{10}$ alloy. The mainspring produced in this manner has the advantage of having even higher tensile strength and higher ductility. It operates according to a TRIP mechanism with the appearance of two phases, FCC and HCP, by a twinning mechanism.

The invention is not limited to fabrication of a mainspring. Indeed, other timepiece components could be fabricated from the high-entropy $Fe_{80-x}Mn_xCo_{10}Cr_{10}$ alloy, such as a spring, a staff, an impulse pin, a balance, an arbor, a roller, pallets, a pallet lever, a pallet fork, an escape wheel, a shaft, a pinion, a an oscillating weight, a winding stem, a crown, a jumper spring, a watch case, a bracelet link, a watch bezel, a bracelet clasp . . . .

Figure 2:
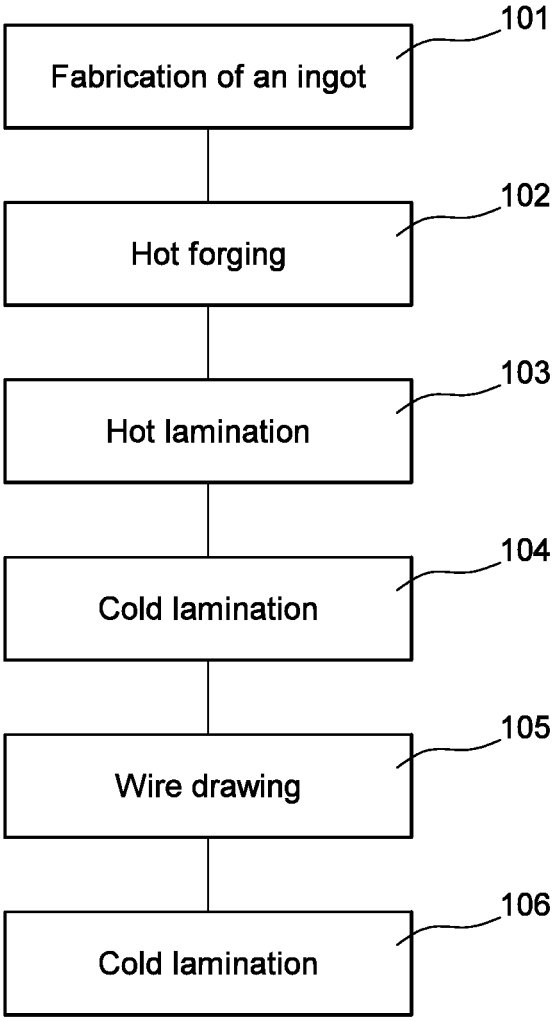
FIG. 2 schematically represents the steps of a method for fabricating a mainspring according to one embodiment of the invention.

FIG. 2 schematically represents the steps of a method for fabricating the mainspring of FIG. 1.

This method includes a first step 101 of fabricating a high-entropy alloy ingot. To do so, the elements are mixed in pure or pre-alloy form, they are then melted, and the mixture is cast to form an ingot.

The method then includes a step 102 of hot forging the ingot.

The method then includes a hot lamination step 103.

The method then includes a cold lamination step 104.

The method then includes a wire drawing step 105.

The method then includes a cold lamination step 106.

Naturally, the invention is not limited to the embodiments described with reference to the Figures and variants could be envisaged without departing from the scope of the invention.

Thus, in the preceding examples, the $Fe_{80-x}Mn_xCo_{10}Cr_{10}$ alloy was used. However, other high-entropy alloys could be used, such as, for example:

$Fe_{20}Mn_{20}Ni_{20}Co_{20}Cr_{20}$,
$Fe_{40}Mn_{27}Ni_{26}Co_5Cr_2$,
$Ta_{20}Nb_{20}Hf_{20}Zr_{20}Ti_{20}$,
$Al_{20}Li_{20}Mg_{10}Sc_{20}Ti_{30}$,
$Cr_{18.2}Fe_{18.2}Co_{18.2}Ni_{18.2}Cu_{18.2}Al_{9.0}$.

The invention claimed is:

1. A timepiece component, comprising:

a high-entropy alloy, wherein the high-entropy alloy is formed of multiple metallic elements forming a single-phase structure, and the high-entropy alloy satisfies formula $Ta_aNb_bHf_cZr_dCr_e$, where a, b, c, d, and e are each a value independently ranging from 1 to 55 at. %.

2. The timepiece component according to claim 1, wherein the high-entropy alloy comprises one or more interstitial elements selected from the group consisting of C, N, and B.

3. The timepiece component according to claim 1, wherein the high-entropy alloy comprises one or more structural hardening elements selected from the group consisting of Ti, Al, Be, and Nb.

* * * * *